United States Patent [19]

Yeagle

[11] 4,158,679

[45] Jun. 19, 1979

[54] WATER DISTRIBUTOR TROUGH PRIMARILY FOR A WARM AIR FURNACE MOUNTED HUMIDIFIER

[75] Inventor: Richard J. Yeagle, Hartland, Mich.

[73] Assignee: General Filters, Inc., Novi, Mich.

[21] Appl. No.: 879,845

[22] Filed: Feb. 22, 1978

[51] Int. Cl.[2] ..... B01F 3/04

[52] U.S. Cl. ..... 261/106; 126/113; 261/DIG. 15

[58] Field of Search ..... 261/97, 103, 106, 29, 261/110, 113, DIG. 15, DIG. 44; 126/113

[56] References Cited

U.S. PATENT DOCUMENTS

| | | | |
|---|---|---|---|
| 2,281,799 | 5/1942 | Quave | 261/97 X |
| 2,809,820 | 10/1957 | Stoops | 261/106 |
| 3,136,829 | 6/1964 | Skerritt | 261/DIG. 15 |
| 3,155,747 | 11/1964 | Perlman | 261/29 |
| 3,193,259 | 7/1965 | Liebmann | 261/97 X |
| 3,199,846 | 8/1965 | Durham et al. | 261/106 X |
| 3,318,587 | 5/1967 | McDuffee | 126/113 X |
| 3,397,872 | 8/1968 | Schipper | 261/110 |
| 3,401,681 | 9/1968 | McDuffee, Sr. | 126/113 |
| 3,437,318 | 4/1969 | Abbott et al. | 261/DIG. 15 |
| 3,464,401 | 9/1969 | McGrath | 126/113 |
| 3,497,453 | 2/1970 | Yurdin | 261/97 X |
| 3,570,822 | 3/1971 | Peterson et al. | 261/29 |
| 3,774,588 | 11/1973 | Yeagle | 261/DIG. 15 |
| 3,867,486 | 2/1975 | Nagele | 261/106 X |
| 3,975,470 | 8/1976 | Engel | 261/106 |

OTHER PUBLICATIONS

Underwriters' Laboratories Inc., "Standard for Electric Fans", UL 507, Jan. 1, 1973, p. 8.

*Primary Examiner*—Richard L. Chiesa
*Attorney, Agent, or Firm*—Cullen, Sloman, Cantor, Grauer, Scott & Rutherford

[57] ABSTRACT

An air treating apparatus such as a warm air furnace mounted humidifier is provided with an air seal or air lock which seals against air movement out of the apparatus and which prevents the water in the reservoir of the apparatus from being blown out of the apparatus to the atmosphere or ejected from the apparatus by the positive air pressure within the apparatus or furnace, thus eliminating turbulence or splashing of the water outside of the apparatus. This insures that the water in the apparatus is distributed uniformly to the evaporator pad.

9 Claims, 9 Drawing Figures

WATER DISTRIBUTOR TROUGH PRIMARILY FOR A WARM AIR FURNACE MOUNTED HUMIDIFIER

BACKGROUND OF THE INVENTION

1. Field of the Invention

The air treating apparatus may take the form of an evaporator cooler, a cooling tower, a humidifier for use with an air system and especially adapted for installation on a forced air furnace, a free standing humidifier for use in a room, a window humidifier or other kinds of similar air-conditioning or treating apparatuses.

2. Description of the Prior Art

Apparatuses utilizing water distribution means include the structures shown in the following U.S. Patents: No. 3,975,470 to Lewis O. Engel, dated Aug. 17, 1976 and assigned to the assignee of record; No. 2,281,799 to O. E. Quave, dated May 5, 1942; No. 2,809,820 to F. D. Stoops, dated Oct. 15, 1957; No. 3,193,259 to J. M. Liebmann, dated July 6, 1965; No. 3,199,846 to R. F. Durham et al, dated Aug. 10, 1965; No. 3,318,587 to P. E. McDuffee, dated May 9, 1967; 3,401,681 to P. E. McDuffee, Sr. et al, dated Sept. 17, 1968; No. 3,464,401 to W. L. McGrath, dated Sept. 2, 1969; No. 3,497,453 to A. Yurden, dated Feb. 24, 1970; No. 3,570,822 to C. D. Peterson, dated Mar. 16, 1971; and other patents cited therein.

Underwriters' Laboratories, Inc.'s "Standard For Electric Fans", UL 507, effective January 1, 1973, provides on page 8 thereof for backflow prevention in evaporative coolers. Paragraph 5.1 provides that an air gap shall be provided to prevent backflow into a water supply system from the storage reservoir of an evaporative cooler. Paragraph 5.2 provides that the design of an air gap fitting shall assure that an unobstructed minimum vertical distance of one inch or two inlet pipe inside diameters, whichever is greater, will be permanently maintained through the free atmosphere between the lowest opening of the water inlet device supplying water to the evaporative cooler and the flood level rim of the reservoir receiving the water.

SUMMARY OF THE PRESENT INVENTION

It is a feature of the present invention to provide an air treating apparatus such as a humidifier, evaporator cooler, cooling tower or other such equipment with an air seal or air lock which seals against air movement out of the reservoir and which prevents the water in the apparatus from being blown out to the atmosphere or ejected from the apparatus by the positive air pressure within the apparatus, thus eliminating turbulence or splashing of the water outside of the apparatus.

A further feature of the present invention is to provide an air treating apparatus of the aforementioned type which includes a housing provided with an evaporator pad and water distribution means mounted in the housing above the evaporator pad, with the distribution means including a generally rectangular tray having a cover secured thereto. With such a construction, the tray is provided with a sump and an overflow rim which together define a reservoir which is in flow communication with channels leading to apertures provided in the tray.

A still further feature of the present invention is to provide an air treating apparatus of the aforementioned type in which the cover is provided with an elongated tubular spout open at both ends, with the spout having its bottom edge extending into the sump and with a water fitting having a discharge end being located above and spaced from the spout and the cover to provide an air gap between the discharge end of the water fitting and the sump to prevent backflow of the water in the reservoir into the potable source.

Another feature of the present invention is to provide an air treating apparatus of the aforementioned type in which the air seal is formed in the tray when the water rises in the sump to a place above the bottom edge of the spout thus sealing against air movement out of the reservoir and preventing the positive air pressure existing within the apparatus from ejecting the water from the reservoir to the atmosphere thereby eliminating turbulence and splashing of the water. With such a construction, once the air or water seal is formed, the water rises in the reservoir and overflows the rim into the channels and apertures where the water is distributed uniformly to the evaporator pad.

Still another feature of the present invention is to provide an air treating apparatus in which each of the apertures provided in the tray has an air seal or water seal structure to seal against air movement out of the reservoir.

A further feature of the present invention is to provide an air treating apparatus of the aforementioned type which is simple in construction, is economical to manufacture, and is efficient in operation.

DESCRIPTION OF A PREFERRED EMBODIMENT

Figure 1:
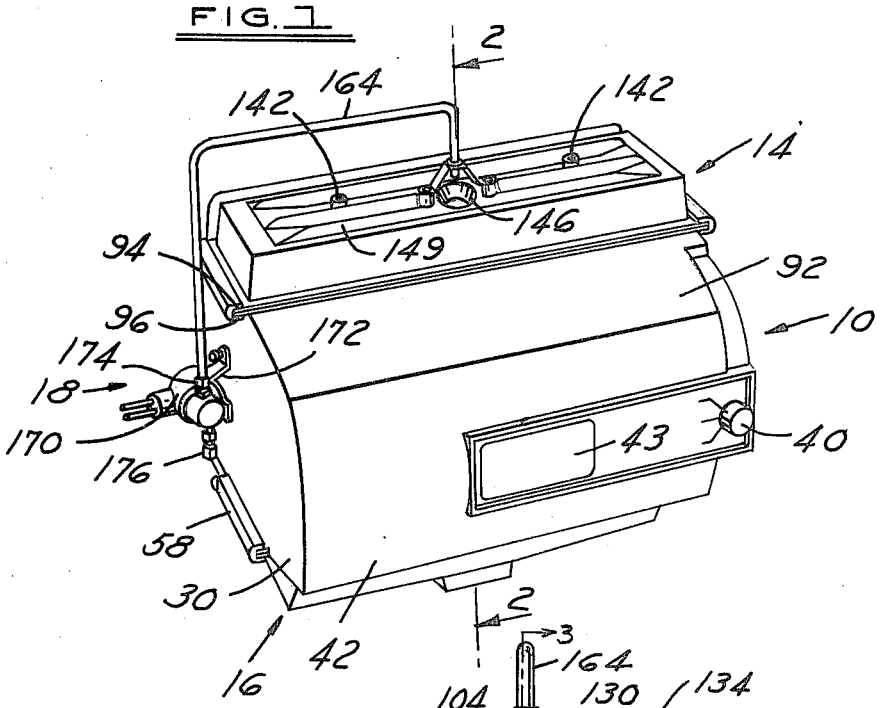
FIG. 1 is a perspective view of a humidifier constructed in accordance with my invention.

Referring now to the drawings, the humidifier or air treating or conditioning apparatus comprises a housing 10, an evaporator pad 12 within the housing 10, a water distribution trough or tray 14 removably mounted on the top of the housing 10, a drain pan 16 removably secured to the bottom of the housing 10, and water supply means 18 for delivering water to the distributor trough or tray 14.

Figure 2:
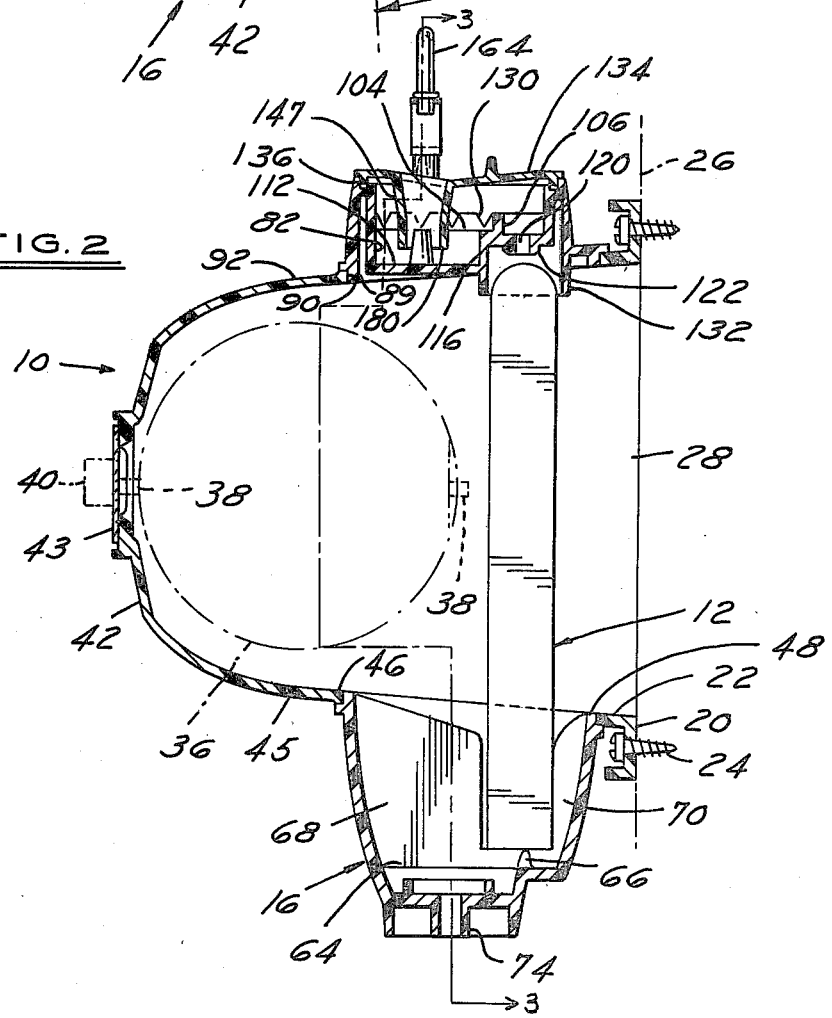
FIG. 2 is a sectional view taken on the line 2—2 in FIG. 1.

The housing 10, as an example, is adapted to be installed on any vertical surface of an air system, particularly a forced air furnace. As shown in FIG. 2, the flat rear wall 20 of the housing 10 has a central opening 22 which is removably secured as by sheet metal screws 24 to a vertical surface 26 of a forced air furnace over an opening 28 therein.

The housing 10 has side walls 30 and 32. The side wall 30 has the water supply means 18 mounted thereon as will be described more fully hereinafter. The side wall 32 has a circular opening 34 therein, the effective size of which is controlled by a circular damper or closure plate 36 hinged by pins 38 journaled in opposite sides of the opening 34 and controlled as to its position by a control knob 40 (FIG. 1) connected to one of the pins 38 and disposed on the front wall 42 of the housing 10. A name plate 43 mounted on the front wall 42 is removable to enable the inside of the humidifier to be inspected.

The evaporator pad 12 is supported upright within the housing 10 between the opening 34 in a side wall 32 and the opening 22 in the rear wall 20. Accordingly, air moving through the system must flow through the evaporator pad 12 to pick up moisture contained therein. The evaporator pad 12 may be formed of any suitable construction and normally is made of a foraminous material having numerous small though unobstructed passages adapted to retain water by capilarity to be picked up by air passing through it.

The evaporator pad 12 is seated upon and within the drain pan 16 removably secured to the bottom of the housing 10. The bottom wall 45 of the housing has a rectangular opening 46 which is of complementary size and shape to the rectangular upstanding rib 48 on the top of the drain pan 16 so as to snugly receive the latter with the end flanges of the drain pan 16 in surface contact with the flanges extending outwardly from the side walls of the housing 10 near the bottom thereof as is disclosed in the Engel's U.S. Pat. No. 3,975,470 assigned to the assignee of record. The lower surfaces of flanges 50 have grooves, not shown, extending from front to rear. The upper surfaces of flanges 52 have grooves, not shown, extending from front to rear. Flanges 50 and 52 are mounting flanges and when in contact, provide clip-receiving projections 56, the grooved top and bottom surfaces of which are tapered. Complementary channel-shaped clips 58 are provided, the opposite flanges 60 of which are longitudinally tapered to the same degree as the clip-receiving projections 56 and are provided with inward indentations or detents, not shown, adapted to engage in the grooves as disclosed in the Engel Patent.

The bottom 64 of the drain pan 16 has a longitudinally extending upright rib 66 upon which the bottom of the evaporator pad 12 is adapted to rest. Upright ribs 68 and 70 engage the front and rear surfaces of the evaporator pad 12 to hold it in an erect position. The rib 66 has a notch, not shown, to permit water drainage to pass under the pad 12 to the drain opening 74 from whence it may be discharged through a drain pipe (not shown) connected thereto.

The water distribution trough or tray 14 is rectangular in form and has a horizontal bottom wall 76, vertical side walls 80 and 82, and vertical end walls 84 and 86. The tray 14 has a surrounding depending skirt portion 88 provided with a rib 89 of rectangular form which is adapted to fit in a complementary rectangular opening 90 in the top wall 92 of the housing 10. End flanges 94 on the skirt portion 88 engage and rest upon the outwardly extending flanges 96 on the housing 10. Such flanges 94 and 96 are mounting flanges and cooperate to define clip-receiving projections, the top and bottom surfaces of which are tapered to the same extent as the clip-receiving projections 56. Additional clips 58 identical to those previously described and applied in the same way are used to secure the engaged flanges 94 and 96 together to removably mount the water distribution tray 14 on the housing 10.

The bottom wall 76 of the tray 14 is flat and is at the same elevation except in the center thereof where a sump 98 is provided which is surrounded by a raised flat overflow rim 100 of U-shape configuration which on one end 102 abuts wall 82 and on the other end 104 abuts wall 82.

The sump 98, overflow rim together with vertical wall elements 104, 106 and 108 and side wall 82 form a rectangular reservoir 110 midway between the end walls 84 and 86.

Figure 3:
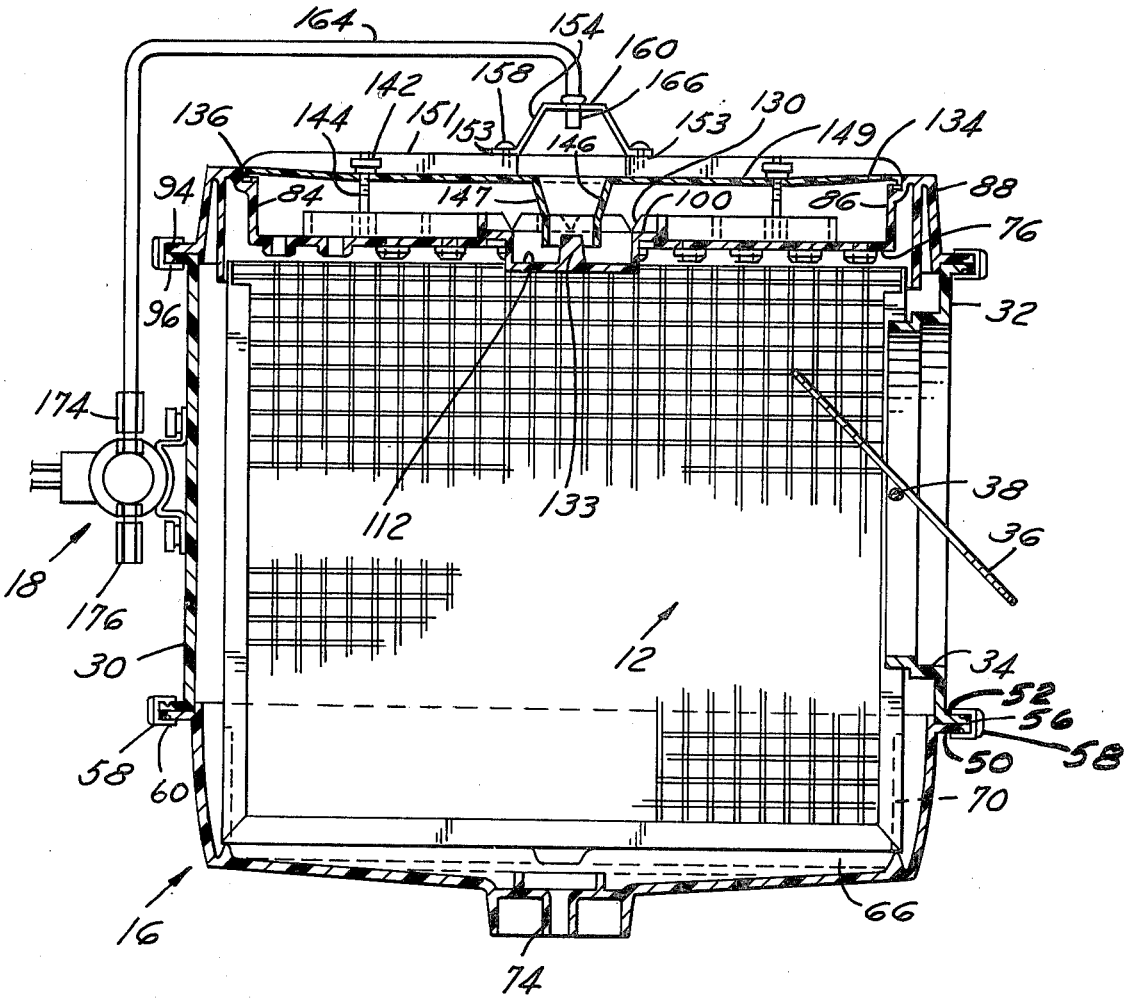
FIG. 3 is a fragmentary sectional view taken on the line 3—3 in FIG. 2, with parts broken away.

The sump 98 has a flat bottom wall portion 112 (FIG. 3) which is at a lower elevation than the remaining portion of bottom wall 76 and is surrounded by side walls 114, 116, 118 and by the opposing side wall 82. The flat rim 110 is at a higher elevation than bottom wall 76 as shown in FIG. 3.

The parallel wall elements 104 and 108 extend perpendicular to the side wall 82 and the wall element 106 extends parallel thereto. Circular apertures 120 are formed in the bottom wall 76 at uniformly spaced intervals along the length of the bottom wall 76 adjacent to the side wall 80. These apertures 120 are all of the same diameter and are disposed directly over the upper edge of the evaporator pad 12 and terminate in depending tubular extensions 122. The purpose of tubular extensions 122 is to prevent water from clinging to the undersurface of the tray 14 and dropping on one portion only of the evaporator pad 12.

The bottom 76 of the tray 14 has additional vertical internal wall elements 126 which define channels 128 extending from the reservoir 110 forming wall elements 104, 106 and 108 to the respective apertures 120. Each channel leads to one of the apertures 120. The overflow rim 100 of the reservoir 110 is elevated relative to the bottom walls 76 of the channels 122 to provide a head of water in the reservoir.

Metering passages are provided to transfer water from the reservoir 110 to the channels 128 for ultimate discharge through the apertures 120. One such metering passage is provided in communication with each channel. Each metering passage is in the form of a V-shaped notch 130 in the top edge of one of the reservoir forming wall elements 104, 106 and 108. The notches 130 are of identical size and shape. As the water supply rises in the reservoir, more and more water is discharged through the metering notches 130 into the respective channels.

The water distribution tray 14 has a depending rectangular skirt or shroud 132 which surrounds the tubular extensions 122 of the apertures 120 and also surrounds the upper edge portions of the evaporator pad 12. The shroud or skirt 132 stabilizes the evaporator pad 12 and holds it upright and also prevents the water dripping from the apertures 120 from being deflected away from the pad 12 by the air flow through the humidifier.

The rib 89 on the tray 14 is the same size and shape as the rib 48 on the drain pan 16, and the opening 90 in the top wall 92 of the housing 10 is the same size and shape as the opening 46 in the bottom wall 45 of the housing 10. Accordingly, the tray 14 and drain pan 16 are interchangeable, that is, the tray 14 can be mounted over the opening 46 and the drain pan 16 can be mounted over the opening 90 in the event it is necessary to invert the housing 10 as explained in the Engel U.S. Pat. No. 3,975,470.

The sump 98 is provided with a centrally located post 133 which is secured to and extends upwardly from the bottom 112.

The tray 14 has a cover or lid 134 which is rectangular in form and is provided with a sealing rib 136 extending around its periphery for contact with a sealing element 138 disposed in a rectangular groove formed in the top surface of the tray 14 around its side and end walls. The cover 134 is removably secured to the tray 14 by any suitable means, here shown as comprising nuts 142 threaded on upright post 144 molded into certain of the internal wall elements 126. The top surface of the tray 14 has a central aperture 146 and open ended integral funnel-shaped spout 147 depending downwardly from the bottom surface of the tray 14. The spout 147 extends over and is spaced from post 133 as shown in FIGS. 2 and 3.

Figure 4:
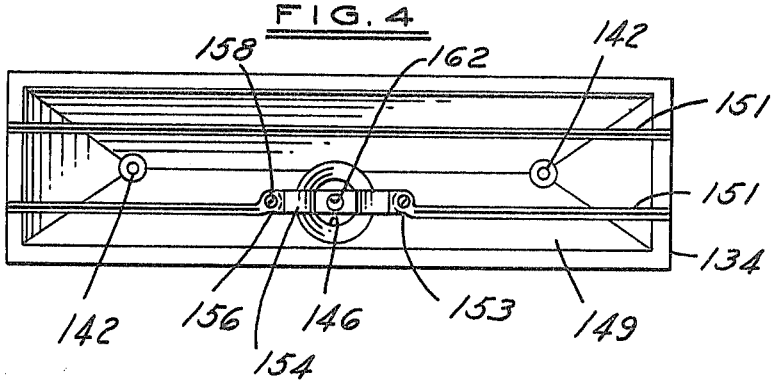
FIG. 4 is a top view of the cover used on the tray of the humidifier.
Figure 5:
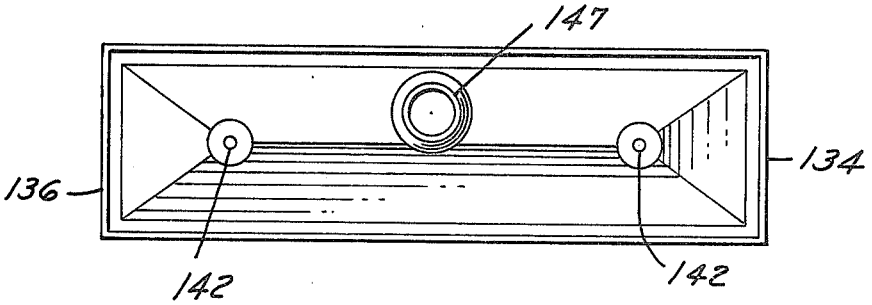
FIG. 5 is a bottom view of the cover shown in FIG. 4.
Figure 6:
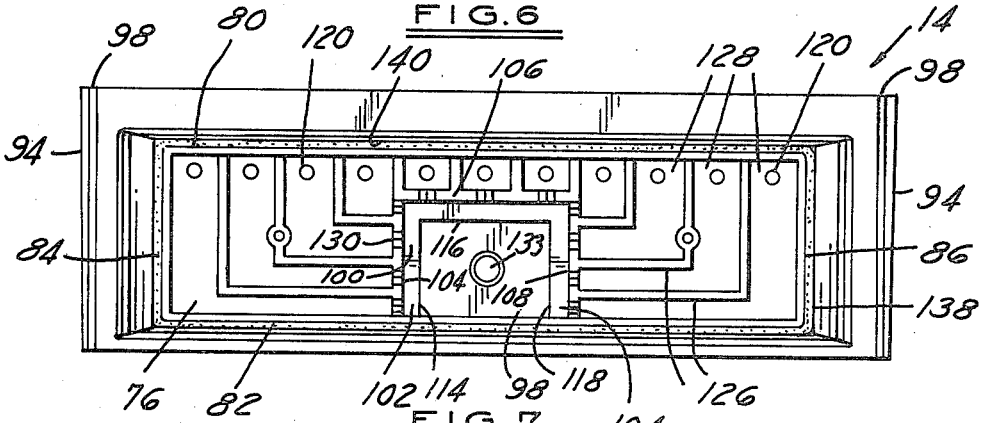
FIG. 6 is a top plan view of the water distribution tray with the cover removed.
Figure 7:
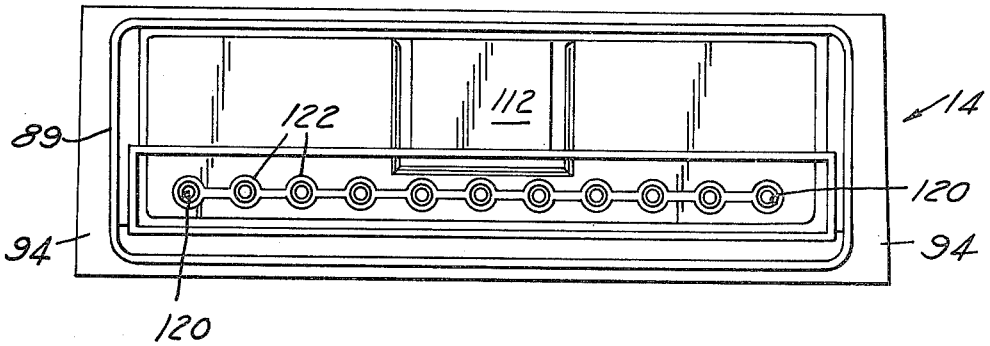
FIG. 7 is a bottom plan view of the tray.

The upper surface of the cover 134 is downwardly dished where indicated at 149 around the central opening 146 leading into the spout 147. The top surface of the cover 134 is provided with a pair of laterally spaced longitudinally extending strengthening ribs 151 (FIG. 4). One of the ribs 151 is interrupted by the opening 146 and is thus divided into two sections, the opposing ends of adjacent sections terminating in integral upstanding boss elements 153. A bracket assembly 154 has a pair of end portions 156 which overlie the boss elements 153 and are secured thereto by screws 158. The portions of bracket assembly 154 intermediate the end extend upwardly and includes a horizontal bridge portion 160 located directly above and spaced from the opening 146 and spout 147 as shown in FIGS. 2 and 3.

The bridging element or portion 160 of the bracket assembly 154 has a centrally located opening or hole 162. A water supply tube 164 has its discharge end 166 secured in the hole 162 to supply water to the sump 98 and reservoir 110. The tube 164 is connected to a suitable pump or similar means (not shown) for supplying water under pressure. The discharge end 166 of tube 164 is located at least an inch above the reservoir 110 so as to provide an air gap and to prevent contamination of the potable source, thereby meeting the standards of Underwriters Laboratories, Inc. discussed previously.

The flow of water to the pipe 164 is controlled by a solenoid valve 170 carried by a bracket 172 secured to the side wall 30 of the housing by fasteners. A fitting 174 connects the tube 164 to the solenoid valve 170 and a second fitting 176 is for connecting the valve 170 to a water pump or the like. The solenoid valve 170 may be connected with the blower circuit of the furnace so as to open when the furnace blower is on and close when the blower is turned off. A humidistat may be connected in series with the solenoid valve 170 to permit automatic control of relative humidity in the humidified air space.

The humidifier is mounted as shown in FIG. 2 with care so that the bottom of the tray 14 is horizontal. In that way, an equal distribution of water through the various apertures 112 will be assured. However, because of the construction of the metering notches and the channels leading to the various apertures, any slight departure from horizontal will not particularly affect the uniform distribution of water to the evaporator pad. The reservoir 110 is midway between the end walls of the tray. Hence even if the tray is tipped so that one end is a certain distance below the other end, the distance that one of the reservoir defining wall elements 104, 108 is below the other is much less. Accordingly, if the tray is tipped slightly, the notches 130 in the two wall elements 104, 108 will discharge substantially the same flow of water. The elevated overflow rim 100 of the reservoir 110 creates a head of water to facilitate the transfer of water through the metering notches 130 into the channels 122.

When required, water from the source flows through tube 164, is discharged via tube outlet across the air gap into the spout 147 from where the water is discharged into the sump 98. The level of the water in sump 98 rises. Once the water level in sump 98 is at a higher elevation than the bottom edge or surface 180 provided on the spout 147, an air lock or air seal is formed by the water which prevents air movement out of the sump and reservoir due to the positive air pressure in the humidifier or furnace.

The construction of the humidifier of FIGS. 1–7 inclusive is like the humidifier construction described in Engel's U.S. Pat. No. 3,975,470 except that the present invention includes a sump 98 and overflow rim 100 which form part of the reservoir 110, an upstanding post 133, a cover spout 147 and a bracket assembly 154 for mounting the tube 164 above the cover to provide an air gap.

Figure 8:
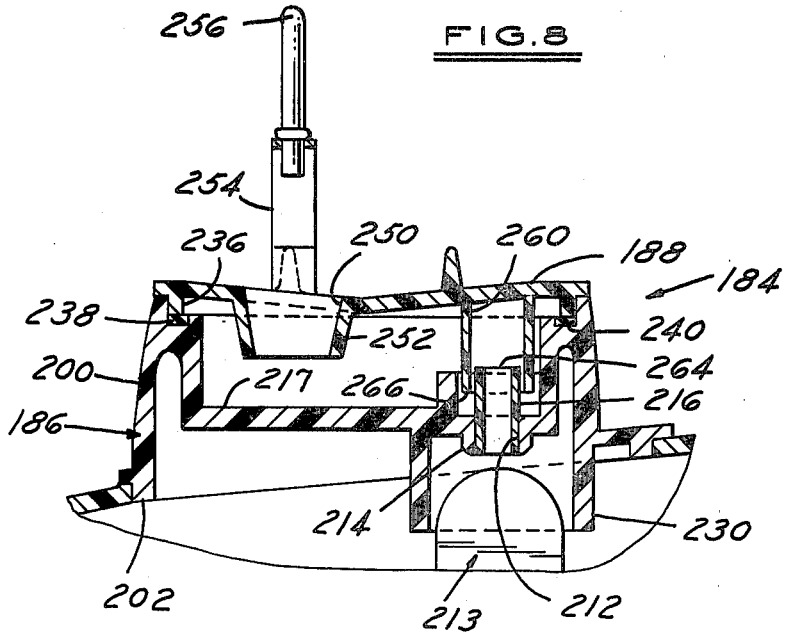
FIG. 8 is a sectionl view through a modified humidifier showing another way for forming air seals in the water distribution tray and cover assembly.
Figure 9:
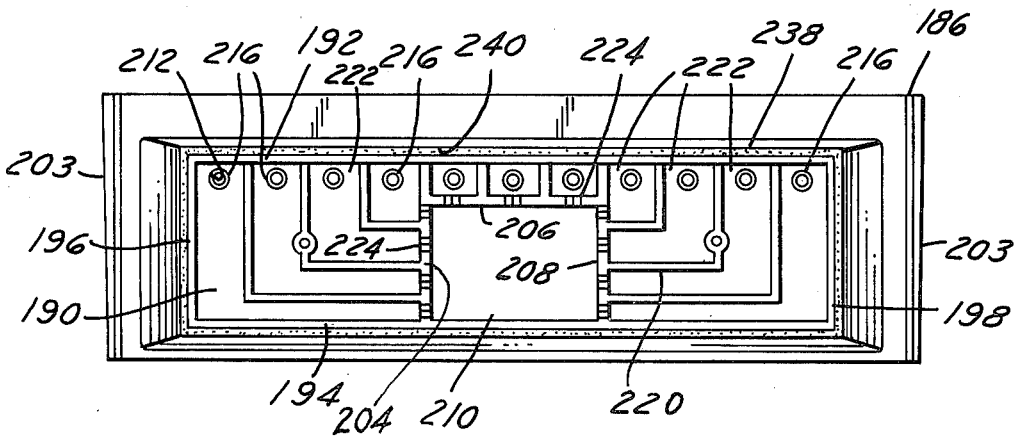
FIG. 9 is a top plan view of the modified water distribution tray with the cover removed.

The modified humidifier 184 shown in FIGS. 8 and 9 is different from the preferred embodiment described previously in the construction of the tray 186 and cover 188 and the manner in which the tray 186 and cover 188 cooperate to form a water seal or lock to prevent air movement out of the reservoir; otherwise both humidifiers are essentially the same in construction.

The water distribution trough or tray 186 is rectangular in form and has a horizontal bottom wall 190, vertical side walls 192 and 194, and vertical end walls 196 and 198. The tray 186 has a surrounding depending skirt portion 200 provided with a rib 202 of rectangular form which is adapted to fit in a complementary rectangular opening in the top wall of the humidifier housing as in the preferred embodiment. End flanges 203 on this skirt portion engage and rest upon the outwardly extending flanges on the housing. The engaging flanges are retained by clips as in the preferred embodiment.

The bottom wall 190 of the tray 186 has internal vertical wall elements 204, 206 and 208 which together with the side wall 194 form a rectangular reservoir 210 midway between the end walls. The parallel wall elements 204 and 208 extend perpendicular to the side wall 194 and the wall element 206 extends parallel thereto. Circular apertures 212 are formed in the bottom wall 190 at uniformly spaced intervals along the length of the bottom wall adjacent to the side wall 192. These apertures 212 are all of the same diameter and are disposed in a row directly over the upper edge of the evaporator pad 212 and terminate in depending tubular extensions 214. The purpose of these extensions 214 is to prevent water from clinging to the undersurface of the tray and dropping on one portion only of the evaporator pad. Each aperture 212 is provided with a tubular element 216.

The bottom 190 of the tray 186 has additional vertical internal wall elements 220 which define channels 222 extending from the reservoir 210 forming wall elements 204, 206 and 208 to respective apertures 212 via the tubular elements 216. Each channel 222 leads to one of the apertures. The bottom wall 217 of the reservoir 210 is elevated relative to the bottom walls of the channels 222 to provide a head of water in the reservoir 210.

Metering passages are provided to transfer water from the reservoir 210 to the channels 222 for ultimate discharge through the apertures 212. One such metering passage is provided in communication with each channel. Each metering passage is in the form of a V-shaped notch 224 in the top edge of one of the reservoir forming wall elements 204, 206 and 208. The notches 224 are of identical size and shape. As the water supply rises in the reservoir, more and more water is discharged through the metering notches 224 into the respective channels.

The water distribution tray 186 has a depending rectangular skirt or shroud 230 which surrounds the tubular extensions 214 of the apertures 212 and also surrounds the upper edge portion of the evaporator pad 213. This shroud or skirt 230 stabilizes the evaporator pad 213 and holds it upright and also prevents the water dripping from the apertures from being deflected away from the pad by the air flow through the humidifier.

The tray 186 has a cover or lid 188 which is rectangular in form and has a sealing rib 236 extending around its periphery for contact with a sealing element 238 disposed in the rectangular groove 240 formed in the top surface of the tray 186 around its side and end walls. The cover 188 is removably secured to the tray 186 in generally the same manner as in the other embodiment.

The cover 188 has a centrally located opening 250 concentric with a spout 252 located above the reservoir 210. A bracket assembly 254, similar in construction to the corresponding part in the preferred embodiment, holds the tube 256 elevated relative to the reservoir to provide for an air gap which meets the aforementioned standards of Underwriters' Laboratories, Inc.

The cover 188 adjacent one edge thereof is provided with a row of longitudinally spaced tubular members 260 equal in number to the number of tubular elements 216. One tubular element 216 cooperates with one tubular member 260 as shown in FIG. 8. The tubular element 216 extends into and is spaced from the interior surface of the corresponding tubular member 260.

Each tubular member 260 has its upper surface 262 secured to the bottom surface of the cover 188. Each tubular element is secured in the corresponding aperture 212 as may be secured to the top surface of the bottom wall concentric with the aperture.

The top surface 264 of each tubular element is at an elevation higher than the elevation of the vertical wall elements 204, 206 and 208. The bottom surface 266 of each tubular member 260 is at a lower elevation than the elevation of the vertical wall elements 204, 206 and 208.

When required, water from the source flows through the tube 256, is discharged across the air gap into the spout 252 from where the water is discharged into the reservoir 210. The level of the water rises in reservoir 210 and more and more water is discharged through the metering notches 224 into the respective channels 222.

The water in each channel 222 first reaches the bottom surface or edge 266 of the outer tubular member 260 to form a seal or lock. Thereafter the water rises in the space between the corresponding tubular element 216 and member 260 until the water reaches the elevation of the top surface 264 of the tubular element 216. Once surface 264 is reached the water falls through the tubular element 216 to the evaporator pad 213.

Thus a seal is formed in each channel for each aperture when the water level reaches the elevation of surface 266. Thus air locks or air seals are formed by the water which prevent air movement out of the reservoir due to the positive air pressure in the humidifier or furnace.

I claim:

1. An air treating apparatus comprising a housing, an evaporator pad mounted in said housing, water distribution means disposed above said evaporator pad for providing a substantially uniformly distributed flow of water to said evaporator pad, said water distribution means comprising an elongated rectangular tray having a bottom wall and upright side and end walls, a sump provided in said bottom wall adjacent one of said side walls and spaced from the other side wall and from said end walls, the bottom of said sump being at a lower elevation than the remaining portion of said bottom wall, an overflow rim at the upper edge of said sump extending from one portion of said one side wall around the upper edge of said sump to another portion of said one side wall, internal upright wall elements secured to said overflow rim and being spaced from said sump to define with said sump and with said one side wall a water reservoir, said tray having a plurality of longitudinally spaced apertures outside of said reservoir along said other side wall, means providing channels from said internal wall elements to said respective apertures, metering passages in said internal wall elements respectively placing said channels in communication with said water reservoir and said overflow rim, a cover secured over said tray and provided with an elongated tubular spout opened at both ends, said spout having its bottom edge extending into the sump of said tray, means for supplying water to said sump and reservoir through said spout, the water in said sump rising to a level at or above the bottom edge of said tubular spout resulting in the formation of a seal which prevents air movement out of said reservoir through said spout, the water thereafter rising in said reservoir and overflowing said rim into said channels and apertures.

2. An air treating apparatus comprising a housing, an evaporator pad mounted in said housing, water distribution means disposed above said evaporator pad for providing a substantially uniformly distributed flow of water to said evaporator pad, said water distribution means comprising an elongated rectangular tray having a bottom wall and upright side and end walls, a sump provided in said bottom wall adjacent one of said side walls and spaced from the other side wall and from said end walls, the bottom of said sump being at a lower elevation than the remaining portion of said bottom wall, an overflow rim at the upper edge of said sump extending from one portion of said one side wall around the upper edge of said sump to another portion of said one side wall, internal upright wall elements secured to said overflow rim and being spaced from said sump to define with said sump and with said one side wall a water reservoir, said tray having a plurality of longitudinally spaced apertures outside of said reservoir along said other side wall, means providing channels from said internal wall elements to said respective apertures, metering passages in said internal wall elements respectively placing said channels in communication with said water reservoir and said overflow rim, a cover secured over said tray and provided with an elongated tubular spout opened at both ends, said spout having its bottom edge extending into the sump of said tray, a water fitting having a discharge end located above and spaced from said tubular spout and from the outside surface of said cover, means carried by said cover for mounting said water fitting above said spout to provide an air gap between the discharge end of said water fitting and said sump to prevent backflow of the water in said sump and reservoir, the water discharged from said fitting falling through said gap and said tubular spout into said sump from where the water rises in said sump to a place above the bottom edge of said tubular spout resulting in the formation of an air seal, the water thereafter rising in said reservoir and overflowing said rim into said channels and apertures.

3. The air treating apparatus defined in claim 1 wherein said rim lies in a plane having an elevation above said bottom wall.

4. The air treating apparatus defined in claim 1 wherein the bottom of said sump is provided with an integral upstanding post which extends into said tubular spout and is spaced from the inner surface thereof to permit the water to fall into said sump.

5. The air treating apparatus defined in claim 1 wherein said sump is of rectangular configuration and of uniform depth.

6. The air treating apparatus defined in claim 1 wherein said apertures are formed in the bottom wall of said tray in a continuous row located midway between said side wall portions from one end wall portion to the other.

7. The air treating apparatus defined in claim 1 wherein said apertures have tubular extensions projecting downwardly beneath the lower surface of said bottom wall.

8. The air treating apparatus defined in claim 1 wherein said tray has a skirt alongside said apertures extending downwardly beneath said bottom wall in overlapping relation to the upper portion of side evaporator pad.

9. The air treating apparatus defined in claim 1 wherein means are provided for removably securing said tray to said housing comprising a mounting flange on said tray, a mounting flange on said housing engaging said tray mounting flange, and means for securing said flanges together.

* * * * *